US009863125B2

(12) United States Patent
Attwood et al.

(10) Patent No.: US 9,863,125 B2
(45) Date of Patent: Jan. 9, 2018

(54) EXCAVATION TOOTH ASSEMBLY

(71) Applicant: Bradken Resources Pty Limited, Mayfield West, NSW (AU)

(72) Inventors: Reece Attwood, Mayfield West (AU); David Hoad, Buddina (AU)

(73) Assignee: Bradken Resources Pty Limited, Mayfield West, NSW (AU)

( * ) Notice: Subject to any disclaimer, the term of this patent is extended or adjusted under 35 U.S.C. 154(b) by 11 days.

(21) Appl. No.: 14/783,719

(22) PCT Filed: Apr. 11, 2014

(86) PCT No.: PCT/AU2014/000412
§ 371 (c)(1),
(2) Date: Oct. 9, 2015

(87) PCT Pub. No.: WO2014/165931
PCT Pub. Date: Oct. 16, 2014

(65) Prior Publication Data

US 2016/0069046 A1 Mar. 10, 2016

(30) Foreign Application Priority Data

Apr. 12, 2013 (AU) ..... 2013204898

(51) Int. Cl.
*E02F 9/28* (2006.01)

(52) U.S. Cl.
CPC ..... *E02F 9/2825* (2013.01); *E02F 9/2833* (2013.01); *E02F 9/2858* (2013.01); *E02F 9/2891* (2013.01)

(58) Field of Classification Search
CPC ..... E02F 9/2808; E02F 9/2816; E02F 9/2825; E02F 9/2833; E02F 9/2858
See application file for complete search history.

(56) References Cited

U.S. PATENT DOCUMENTS 2,050,014 A * 8/1936 Morrison ..... E02F 9/2825 37/454
2,689,419 A 9/1954 Daniels et al.
(Continued)

FOREIGN PATENT DOCUMENTS

CA 2852940 A1 * 4/2013 ..... E02F 9/2825
CN 202809692 3/2013
(Continued)

OTHER PUBLICATIONS

International Search Report dated Jun. 18, 2014, directed to International Application No. PCT/AU2014/000412, 7 pages.
(Continued)

*Primary Examiner* — Matthew D. Troutman
(74) *Attorney, Agent, or Firm* — Morrison & Foerster LLP

(57) ABSTRACT

An excavation tooth assembly comprising: a first tooth member including a nose portion; and a second tooth member comprising a body having opposite first and second ends and a socket extending into the body from the first end to finish at an end wall, the first and second tooth members arranged in an assembled condition where the nose portion of the first tooth member is received within the socket of the second tooth member, wherein the tooth members being configured in the assembled condition with opposed surface portions of the socket located towards the second end of the second tooth member bearing on the nose portion of the first tooth member and clearance gaps are provided between opposed surface portions of the socket located towards the first end of the second tooth member and the nose portion.

17 Claims, 7 Drawing Sheets

(56) References Cited

U.S. PATENT DOCUMENTS

| | | | | |
|---|---|---|---|---|
| 2,921,391 | A | 1/1960 | Opsahl | |
| 3,089,263 | A | 5/1963 | Henkel | |
| 3,455,040 | A | 7/1969 | Ratkowski | |
| 5,172,501 | A * | 12/1992 | Pippins | E02F 9/2825 37/453 |
| 5,709,043 | A | 1/1998 | Jones et al. | |
| 5,765,301 | A | 6/1998 | Clendenning | |
| 5,918,391 | A | 7/1999 | Viñas Peya | |
| 6,247,255 | B1 | 6/2001 | Clendenning | |
| 9,469,974 | B2 * | 10/2016 | Guimaraes | E02F 9/2825 |
| 2004/0244235 | A1 * | 12/2004 | Molino | E02F 9/2841 37/450 |
| 2007/0051022 | A1 * | 3/2007 | Meyers | E02F 9/2825 37/455 |
| 2012/0304505 | A1 | 12/2012 | Ruvang | |
| 2013/0097894 | A1 * | 4/2013 | Pippins | E02F 9/2825 37/455 |
| 2013/0180137 | A1 * | 7/2013 | Hurley | E02F 9/2825 37/455 |
| 2014/0223785 | A1 | 8/2014 | Marchand | |
| 2015/0197922 | A1 * | 7/2015 | Freund | E02F 9/2883 29/525.01 |

FOREIGN PATENT DOCUMENTS

| | | | | |
|---|---|---|---|---|
| EP | 2799631 | A2 * | 11/2014 | E02F 9/2825 |
| EP | 1469713 | B1 * | 2/2016 | E02F 9/2825 |
| ES | EP 2730705 | A1 * | 5/2014 | E02F 9/2841 |
| ES | WO 2015011012 | A1 * | 1/2015 | E02F 9/2825 |
| WO | WO/2013/030336 | | 3/2013 | |

OTHER PUBLICATIONS

Australian Examination Report No. 2 dated Apr. 6, 2016, directed to Australian Application No. 2013204898; 6 pages.

Australian Patent Examination Report No. 2 dated May 4, 2016, directed to Australian Application No. 20132014929; 8 pages.

Examination Report dated Jul. 30, 2016, directed to AU Patent Application No. 2013204898; 3 pages.

* cited by examiner

EXCAVATION TOOTH ASSEMBLY

CROSS-REFERENCE TO RELATED APPLICATIONS

This application is a national stage application under 35 U.S.C. 371 of International Patent Application No. PCT/AU2014/000412, filed on Apr. 11, 2014, which claims the priority of Australian Application No. AU 2013204898, filed Apr. 12, 2013, the contents of which are incorporated herein by reference in their entirety.

FIELD OF THE INVENTION

The present disclosure relates to excavation tooth assemblies for attachment to digging devices. The present disclosure also relates to components of excavation tooth assemblies including tooth members.

BACKGROUND OF THE INVENTION

Excavation teeth are provided on the digging edge of various pieces of digging equipment such as the buckets of front end loaders. Each excavation tooth is formed of a number of tooth members, commonly a point and an adapter and one or more locks for locking the tooth members together. The adapter is typically fitted to the excavation equipment and the point fits over a nose of the adapter and is retained in place by the lock. In some instances one or more intermediate tooth members may be also included between the point and the adapter. For ease of description it is to be understood that, unless the context requires otherwise, the term "adapter" used in this specification includes both the adapter arranged to be fitted to the excavation equipment or, if one or more intermediate tooth members are provided, to that intermediate tooth member(s) or to the combination of the adapter and the intermediate tooth member(s).

Also, unless the context requires otherwise, the term "nose" used in this specification is a projecting portion to which a tooth member of the excavation tooth is mounted and includes a projecting portion on the excavation equipment to which the adapter is mounted, a projecting part on the adapter to which the point or intermediate tooth member is mounted and a projecting part on the intermediate tooth member to which the point or other tooth members are mounted.

The reason that the excavation tooth is formed of a number of parts is to avoid having to discard the entire tooth when only a part of the tooth, in particular the ground engaging part of the tooth (i.e. the point) is worn or broken.

Various types of locks, points and adapters are known. However, it is always desirable to design new excavation tooth assemblies and parts thereof.

SUMMARY OF THE INVENTION

The present disclosure relates to improvements in relation to tooth members of excavation tooth assemblies.

According to one embodiment of the present disclosure, there is provided an excavation tooth assembly comprising:

a first tooth member including a nose portion; and a second tooth member comprising a body having opposite first and second ends and a socket extending into the body from the first end to finish at an end wall, the first and second tooth members arranged in an assembled condition where the nose portion of the first tooth member is received within the socket of the second tooth member, wherein the tooth members being configured in the assembled condition with opposed surface portions of the socket located towards the second end of the second tooth member bearing on the nose portion of the first tooth member and clearance gaps are provided between opposed surface portions of the socket located towards the first end of the second tooth member and the nose portion.

According to another embodiment of the present disclosure, there is provided a tooth member for attachment to a digging device in an excavation tooth assembly, the tooth member comprising:

a body having opposite first and second ends; and a socket extending into the body from the first end to finish at an end wall for receiving a nose when the tooth member is assembled with a digging device in an assembled condition, the socket being defined by an inner surface of the body comprising opposed bearing surface portions located towards the second end and opposed non-bearing surface portions located towards the first end.

According to another embodiment of the present disclosure, there is provided a tooth member for attachment to a digging device in an excavation tooth assembly, the tooth member comprising:

a body having opposite first and second ends; and a socket extending into the body from the first end to finish at an end wall for receiving a nose when the tooth member is assembled with a digging device in an assembled condition, the socket being defined by an inner surface of the body comprising opposed first surface portions that diverge from each other towards the first end, opposed second surface portions that diverge from each other towards the first end and opposed third surface portions substantially parallel to the each other.

According to another embodiment of the present disclosure, there is provided an excavation tooth assembly comprising:

a first tooth member including a nose portion; and a second tooth member comprising a body having opposite first and second ends and a socket extending into the body from the first end to finish at an end wall, the first and second tooth members arranged in an assembled condition where the nose portion of the first tooth member is received within the socket of the second tooth member, wherein the socket is defined by an inner surface of the body comprising opposed first surface portions that diverge from each other towards the first end, opposed second surface portions that diverge from each other towards the first end and opposed third surface portions substantially parallel to the each other.

According to another embodiment of the present disclosure, there is provided an excavation tooth assembly comprising:

a first tooth member comprising a body extending along a longitudinal axis between opposite first and second ends, the body including a nose portion having at least two surface portions which converge towards the second end of the body, wherein the first tooth member also includes a projection on one of the converging surface portions; and a second tooth member including a socket, the first and second tooth members arranged in an assembled condition where the nose portion of the first tooth member is received within the socket of the second tooth member.

According to another embodiment of the present disclosure, there is provided a tooth member for attachment to a digging device in an excavation tooth assembly, the tooth member comprising:

a body extending along a longitudinal axis between opposite first and second ends, the body including a nose portion for receipt in a socket when the tooth member is assembled with a digging device in an assembled condition, the nose portion having at least two surface portions which converge towards the second end of the body; and a projection on one of the converging surface portions.

According to another embodiment of the present disclosure, there is provided a tooth member for attachment to a digging device in an excavation tooth assembly, the tooth member comprising:

a body extending along a longitudinal axis between opposite first and second ends, and a socket extending into the body from the first end to finish at an end wall for receiving a nose when the tooth member is assembled with a digging device in an assembled condition, the socket having at least two walls which converge towards the second end of the body; and a recess formed in one of the converging walls.

According to another embodiment of the present disclosure, there is provided an excavation tooth assembly comprising:

a first tooth member comprising a body extending between opposite first and second ends, the body having a central longitudinal axis and a nose portion that extends to the second end of the body, the nose portion having a central longitudinal axis that is offset from the central longitudinal axis of the body; and a second tooth member including a socket, the first and second tooth members arranged in an assembled condition where the nose portion of the first tooth member is received within the socket of the second tooth member.

According to another embodiment of the present disclosure, there is provided a tooth member for attachment to a digging device in an excavation tooth assembly, the tooth member comprising:

a body extending between opposite first and second ends, the body having a central longitudinal axis and a nose portion that extends to the second end of the body for receipt in a socket when the tooth member is assembled with a digging device in an assembled condition, the nose portion having a central longitudinal axis that is offset from the central longitudinal axis of the body.

According to another embodiment of the present disclosure, there is provided a tooth member for attachment to a digging device in an excavation tooth assembly, the tooth member comprising:

a body extending between opposite first and second ends, the body having a central longitudinal axis, and a socket extending into the body from the first end to finish at an end wall for receiving a nose when the tooth member is assembled with a digging device in an assembled condition, the socket having a central longitudinal axis that is offset from the central longitudinal axis of the body.

According to another embodiment of the present disclosure, there is provided an excavation tooth assembly comprising:

a first tooth member including a nose portion;

a second tooth member comprising a body having opposite first and second ends including a nose portion extending to the second end, the second tooth member also comprising a socket extending into the body from the first end for receiving the nose portion of the first tooth member in an assembled condition;

a third tooth member comprising a body having opposite first and second ends and a socket extending into the body from the first end for receiving the nose portion of the second tooth member in an assembled condition; and a lock mounted to the second tooth member for locking the third tooth member in its assembled condition with the second tooth member, wherein the lock is configured to remain mounted to the second tooth member when the third tooth member is disassembled from the second tooth member.

According to another embodiment of the present disclosure, an excavation tooth assembly is disclosed having a longitudinal axis and comprising:

a first tooth member including a nose portion;

a second tooth member comprising a body having opposite first and second ends including a nose portion extending to the second end, the second tooth member also comprising a socket extending into the body from the first end for receiving the nose portion of the first tooth member in an assembled condition;

a third tooth member comprising a body having opposite first and second ends and a socket extending into the body from the first end for receiving the nose portion of the second tooth member in an assembled condition; the first, second and third members being disposed along the longitudinal axis and a locking arrangement comprising first and second locks, the first lock arranged to lock the first tooth member to the second tooth member and the second lock arranged to lock the second tooth member to the third tooth member, wherein the first and second locks are installed in respective passages formed in the tooth assembly, the passages extending transverse to, and being spaced apart along, the longitudinal axis.

According to another embodiment of the present disclosure, a tooth member for attachment to a digging device in an excavation tooth assembly is disclosed, the tooth member comprising:

a body extending along a longitudinal axis between opposite first and second ends, the body having a main part extending from the first end and a nose portion that extends from the main part to the second end, the main part including a socket opening to the first end to receive a nose portion of the digging device, and the nose of the body being arranged to be received in a socket of a second tooth member, wherein the tooth member comprises a first locking passage formed in the main part and a second locking passage formed in the nose, the passages extending transverse to the longitudinal axis.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION OF THE INVENTION

Figure 1:
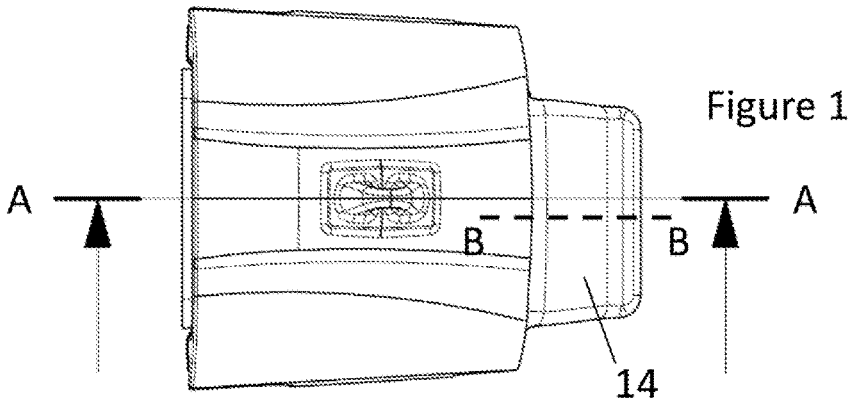
FIG. 1 is a top view of a nose and an intermediate tooth member of an excavation tooth assembly according to an embodiment of the present disclosure in an assembled condition.

In the following detailed description, reference is made to the accompanying drawings, which form a part thereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

The present disclosure relates generally to excavation tooth assemblies for digging equipment. In the illustrated embodiment, an excavation tooth assembly is shown comprising an intermediate tooth member that is mounted to a nose fixed to a digging edge. A point tooth member is mounted to the intermediate tooth member. However, it is to be understood that embodiments of the present disclosure could be applied to excavation tooth assemblies in which the point tooth member is mounted directly on the nose fixed to the digging edge. In the excavation tooth assemblies of the present disclosure, locks are used to lock the tooth members to the nose and the point tooth member to the intermediate tooth member respectively.

Disclosed in some embodiments, is an excavation tooth assembly comprising:

a first tooth member including a nose portion; and a second tooth member comprising a body having opposite first and second ends and a socket extending into the body from the first end to finish at an end wall, the first and second tooth members arranged in an assembled condition where the nose portion of the first tooth member is received within the socket of the second tooth member, wherein the tooth members being configured in the assembled condition with opposed surface portions of the socket located towards the second end of the second tooth member bearing on the nose portion of the first tooth member and clearance gaps are provided between opposed surface portions of the socket located towards the first end of the second tooth member and the nose portion.

In some embodiments, the opposed surface portions of the socket are formed in the top and bottom surfaces of the socket.

In other embodiments, the opposed surface portions of the socket are formed in opposed side surfaces of the socket.

In some embodiments, at least part of the opposed bearing surface portions are substantially parallel to one another.

In some embodiments, at least part of the opposed bearing surface portions diverge from each other as they extend away from the second end of the second tooth member.

In some embodiments, the opposed surface portions bounding the clearance gaps diverge from each other as they extend away from the second end of the second tooth member.

In some embodiments, the opposed bearing surface portions extend from the end wall of the socket towards the first end of the second tooth member.

In some embodiments, the opposed surface portions bounding the clearance gaps extend from the socket opening at the first end of the second tooth member towards the second end.

In some embodiments, the opposed surface portions bearing on the nose are of greater surface area than the opposed surface portions bounding the clearance gaps. This provides the assembled tooth members with good stability and strength when the excavation tooth assembly is in use.

In some embodiments, the second tooth member also comprises one or more stabilizing pads on the opposed surface portions bearing on the nose.

In some embodiments, the one or more stabilizing pads are provided on the diverging parts of the opposed surface portions bearing on the nose.

In some embodiments, the second tooth member comprises one or more stabilizing pads on the end wall of the socket.

In some embodiments, the nose portion has a cavity for receiving a lock for locking the second tooth member to the first tooth member.

In some embodiments, the assembly also comprises a lock for locking the second tooth member to the first tooth member.

In some embodiments, the lock is configured to engage the second tooth member in the assembled condition.

In some embodiments, the lock is configured to engage one or more portions of the second tooth member which are orthogonal to the opposed surface portions bearing on the nose and bounding the clearance gaps.

Disclosed in some embodiments is a tooth member for attachment to a digging device in an excavation tooth assembly, the tooth member comprising:

a body having opposite first and second ends; and a socket extending into the body from the first end to finish at an end wall for receiving a nose when the tooth member is assembled with a digging device in an assembled condition, the socket being defined by an inner surface of the body comprising opposed bearing surface portions located towards the second end and opposed non-bearing surface portions located towards the first end.

In some embodiments, the opposed surface portions of the socket are formed in the top and bottom surfaces of the socket.

In other embodiments, the opposed surface portions of the socket are formed in opposed side surfaces of the socket.

In some embodiments, at least part of the opposed bearing surface portions are substantially parallel to one another.

In some embodiments, at least part of the opposed bearing surface portions diverge from each other as they extend away from the second end of the tooth member body.

In some embodiments, the opposed non-bearing surface portions diverge from each other as they extend away from the second end of the tooth member body.

In some embodiments, the opposed bearing surface portions extend from the end wall of the socket towards the first end of the tooth member body.

In some embodiments, the opposed non-bearing surface portions extend from the socket opening at the first end of the tooth member body towards the second end.

In some embodiments, the opposed surface portions are of greater surface area than the opposed non-bearing surface portions.

In some embodiments, the tooth member also comprises one or more stabilizing pads on the opposed bearing surface portions.

In some embodiments, the one or more stabilizing pads are provided on the diverging parts of the opposed bearing surface portions.

In some embodiments, the tooth member also comprises one or more stabilizing pads on the end wall of the socket.

Disclosed in some embodiments is a tooth member for attachment to a digging device in an excavation tooth assembly, the tooth member comprising:

a body having opposite first and second ends; and a socket extending into the body from the first end to finish at an end wall for receiving a nose when the tooth member is assembled with a digging device in an assembled condition, the socket being defined by an inner surface of the body comprising opposed first surface portions that diverge from each other towards the first end, opposed second surface portions that diverge from each other towards the first end and opposed third surface portions substantially parallel to the each other.

In some embodiments, the second and third opposed surface portions are configured to bear on the nose when the tooth member is in the assembled condition.

In some embodiments, the first opposed surface portions are configured to be non-bearing when the tooth member is in the assembled condition.

In some embodiments, the third opposed surface portions extend from the end wall of the socket towards the first end of the tooth member body.

In some embodiments, the first opposed surface portions extend from the socket opening at the first end of the tooth member body towards the second end.

In some embodiments, the second opposed surface portions are located in a mid section of the socket.

In some embodiments, the second opposed surface portions have a greater surface area than the first or third opposed surface portions.

In some embodiments, the first, second and third opposed surface portions of the socket are formed in the top and bottom surfaces of the socket.

In some embodiments, the first, second and third opposed surface portions of the socket are formed in opposed side surfaces of the socket.

Disclosed in some embodiments is an excavation tooth assembly comprising:

a first tooth member including a nose portion; and a second tooth member comprising a body having opposite first and second ends and a socket extending into the body from the first end to finish at an end wall, the first and second tooth members arranged in an assembled condition where the nose portion of the first tooth member is received within the socket of the second tooth member, wherein the socket is defined by an inner surface of the body comprising opposed first surface portions that diverge from each other towards the first end, opposed second surface portions that diverge from each other towards the first end and opposed third surface portions substantially parallel to the each other.

Disclosed in some embodiments is an excavation tooth assembly comprising:

a first tooth member comprising a body extending along a longitudinal axis between opposite first and second ends, the body including a nose portion having at least two surface portions which converge towards the second end of the body, wherein the first tooth member also includes a projection on one of the converging surface portions; and a second tooth member including a socket, the first and second tooth members arranged in an assembled condition where the nose portion of the first tooth member is received within the socket of the second tooth member.

In some embodiments, the socket of the second tooth member having a plurality of walls, one of which has a recess for receiving the projection when the tooth members are in the assembled condition.

In some embodiments, at least two of the walls of the second tooth member converge as they extend from a first end towards a second end of the second tooth member, wherein the recess for receiving the projection is formed in one of the converging walls.

In some embodiments, the projection has a surface facing to the second of the first tooth member's body. In some embodiments, said surface is curved, preferably convexly.

In some embodiments, the projection extends along the surface portion of the nose portion towards the second end of the first tooth member body.

In some embodiments, the projection thickens as it extends towards the second end of the first tooth member body.

In some embodiments, the projection extends along a mid section of the nose portion.

In some embodiments, the projection has a major surface that is an extension of a surface of the first tooth member body.

Disclosed in some embodiments is a tooth member for attachment to a digging device in an excavation tooth assembly, the tooth member comprising:

a body extending along a longitudinal axis between opposite first and second ends, the body including a nose portion for receipt in a socket when the tooth member is assembled with a digging device in an assembled condition, the nose portion having at least two surface portions which converge towards the second end of the body; and a projection on one of the converging surface portions.

Disclosed in some embodiments is a tooth member for attachment to a digging device in an excavation tooth assembly, the tooth member comprising:

a body extending along a longitudinal axis between opposite first and second ends, and a socket extending into the body from the first end to finish at an end wall for receiving a nose when the tooth member is assembled with a digging device in an assembled condition, the socket having at least two walls which converge towards the second end of the body; and a recess formed in one of the converging walls.

Disclosed in some embodiments is an excavation tooth assembly comprising:

a first tooth member comprising a body extending between opposite first and second ends, the body having a central longitudinal axis and a nose portion that extends to the second end of the body, the nose portion having a central longitudinal axis that is offset from the central longitudinal axis of the body; and a second tooth member including a socket, the first and second tooth members arranged in an assembled condition where the nose portion of the first tooth member is received within the socket of the second tooth member.

In some embodiments, the second tooth member comprises a body extending between opposite first and second ends and having a central longitudinal axis and the socket has a central longitudinal axis that is offset from the central longitudinal axis of the body.

In some embodiments, the first tooth member has recesses formed in the body on either side of the nose portion for receiving part of the second tooth member in the assembled condition.

In some embodiments, one of the recesses is wider than the other.

In some embodiments, the second tooth member comprises arms extending away from the socket on either side of the second tooth member for receipt in respective side recesses in the first tooth member.

In some embodiments, one of the arms is thicker than the other.

In some embodiments, the second tooth member has opposite upper and lower walls and opposite side walls which define the socket, wherein one of the opposite upper and lower walls is thicker than the other or one of the opposite side walls is thicker than the other.

In some embodiments, the thicker wall of the second tooth member has an engagement portion for engagement by a lock to lock the second tooth member to the first tooth member in the assembled condition.

In some embodiments, the thicker arm extends from the thicker wall of the second tooth member.

In some embodiments, a slot extends along the thicker arm into the thicker wall.

In some embodiments, the engagement portion is located in the slot.

Disclosed in some embodiments is a tooth member for attachment to a digging device in an excavation tooth assembly, the tooth member comprising:

a body extending between opposite first and second ends, the body having a central longitudinal axis and a nose portion that extends to the second end of the body for receipt in a socket when the tooth member is assembled with a digging device in an assembled condition, the nose portion having a central longitudinal axis that is offset from the central longitudinal axis of the body.

Disclosed in some embodiments is a tooth member for attachment to a digging device in an excavation tooth assembly, the tooth member comprising:

a body extending between opposite first and second ends, the body having a central longitudinal axis, and a socket extending into the body from the first end to finish at an end wall for receiving a nose when the tooth member is assembled with a digging device in an assembled condition, the socket having a central longitudinal axis that is offset from the central longitudinal axis of the body.

Disclosed in some embodiments is an excavation tooth assembly comprising:

a first tooth member including a nose portion;

a second tooth member comprising a body having opposite first and second ends including a nose portion extending to the second end, the second tooth member also comprising a socket extending into the body from the first end for receiving the nose portion of the first tooth member in an assembled condition;

a third tooth member comprising a body having opposite first and second ends and a socket extending into the body from the first end for receiving the nose portion of the second tooth member in an assembled condition; and a lock mounted to the second tooth member for locking the third tooth member in its assembled condition with the second tooth member, wherein the lock is configured to remain mounted to the second tooth member when the third tooth member is disassembled from the second tooth member.

Referring to the Figures, an illustrative embodiment of an excavation tooth assembly 10 is shown and will now be described.

The excavation tooth assembly 10 comprises a nose 11 and an intermediate tooth member 12 that is mounted to the nose. The assembly 10 also comprises a lock (not shown) which locks the intermediate tooth member 12 to the nose 11. The assembly 10 also comprises a point tooth member 13 that is mounted over the forward projecting nose portion 14 of the intermediate tooth member 12 and a further lock 15 to lock the point tooth member to the intermediate tooth member 12 shown.

The nose 11 comprises a body 20 which is mounted or integrally formed with the digging edge at a first end 21 and extends forwardly away from the digging edge to end in an end face 22 at a second end 23 of the body. The body 20 is also defined by top, bottom and side surfaces 24-27 and has a cavity 28 extending laterally through the body between its opposite side surfaces 26, 27. The cavity 28 is shaped to receive at least part of the lock for locking the intermediate tooth member 12 to the nose 11.

The top and bottom surfaces 24, 25 of the nose body 20 converge towards each other as they extend from the first end 21 to the second end 23 of the body. The top and bottom surfaces 24, 25 each comprise three surface portions; a first portion 30*a, b* extending forwardly from the first end 21 of the body 20, a second portion 31*a, b* in a mid section of the nose body 20, and a third portion 32*a, b* extending rearwardly from the second end 22 of the body 20. Each of the surface portions are substantially planar. The first surface portions 30*a, b* of the top and bottom surfaces 24,25 are substantially parallel to each other. The third surface portions 32*a,b* are also substantially parallel to each other. However, the second surface portions 31 *a,b* (which also extend between respective first and second surface portions) of the top and bottom surfaces 24, 25 converge toward each other as they extend towards the second end 23 of the body 20 (and hence also diverge away for each other as they extend towards the first end 21).

The intermediate tooth member 12 comprises a body 40 extending forwardly from a first end 41 to end in a forwardly projecting nose portion 14 at a second end 43 of the body. The intermediate tooth member 12 has a socket 44 that extends into the body 40 from an opening 45 at the body's first end 41 towards the second end 43, finishing in an end surface 46. The socket 44 receives the nose 11 when the intermediate tooth member is mounted thereto. The nose portion 14 of the intermediate tooth member 12 is configured to be received in a socket 80 of the point tooth member 13 and has a cavity 47 for receiving at least part of the lock that locks the point tooth member to the intermediate tooth member 12.

The intermediate tooth member 12 is also provided with slots 48 on opposing sides of the intermediate tooth member's body 40. The slots 48 are each open to the socket 44 and through the first end 41 of the body 40. The slots also comprises engagement portions 49 for the lock to engage when locking the intermediate tooth member 12 to the nose 11.

The socket 44 is defined by top, bottom and side inner surfaces 50-53 in addition to the socket end surface 46. The top and bottom inner surfaces 50, 51 of the socket converge towards each other as they extend from the first end 41 of the body to the socket end surface 46. The top and bottom inner surfaces 50, 51 each comprise three surface portions; a first portion 60*a,b* extending forwardly from the first end 41 of the body 40, a second portion 61 *a,b* in a mid section of the intermediate tooth member body 40, and a third portion 62*a,b* extending rearwardly from the socket end surface 46. The third surface portions 62*a,b* of the top and bottom inner surfaces 50, 51 are substantially parallel to each other. Each of the surface portions are substantially planar. Whereas, the first and second surface portions 60*a,b* and 61 *a,b* diverge away from each other as they extend towards the first end 41 of the intermediate tooth member body 40. The first surface portions 60*a,b* diverge from each other at a shallower angle than the second surface portions 61 *a,b* diverge from each other. However, in other embodiments, the first and second surface portions may diverge at approximately the same angle or the first surface portions may diverge at a greater angle than the second surface portions.

When the intermediate tooth member 12 is brought into an assembled condition with the nose 11, the nose is received in the intermediate tooth member's socket 44. In this condition, respective surface portions of the top and bottom inner surfaces 50, 51 of the socket 44 oppose respective surface portions of the top and both surfaces 24, 25 of the nose body 20. That is, the first portion 60*a* of the top inner surface 50 of the socket 44 opposes the first portion 30*a* of the top surface 24 of the nose body 20, the first portion 60*b* of the bottom inner surface 51 of the socket 44 opposes the first portion 30*b* of the bottom surface 25 of the nose body 20 and so on.

Figure 2:
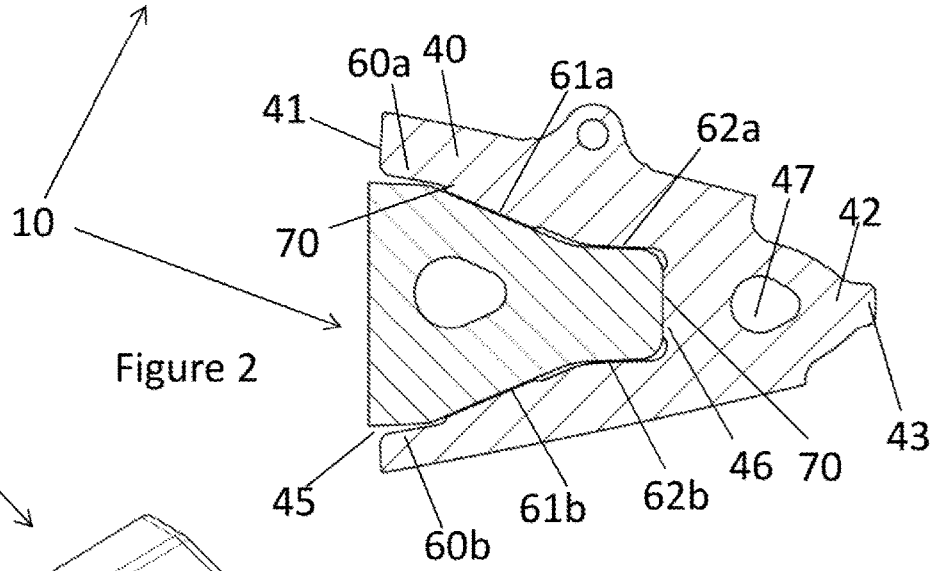
FIG. 2 is cross-sectional side view of the excavation tooth assembly through A-A of FIG. 1.
Figure 3:
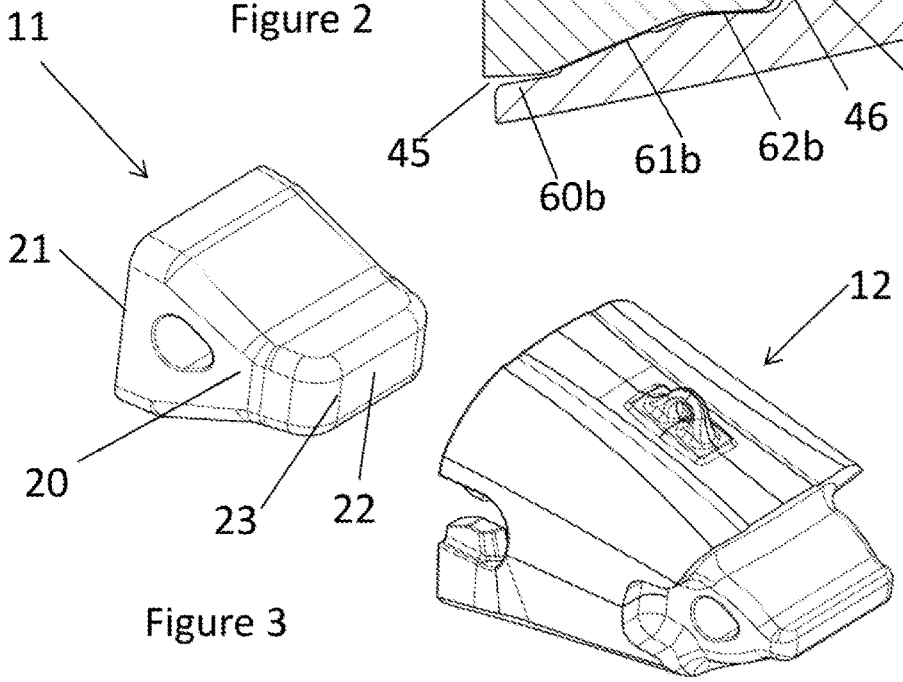
FIGS. 3 and 4 are perspective views of the excavation tooth assembly of FIG. 1 in an unassembled condition.
Figure 4:
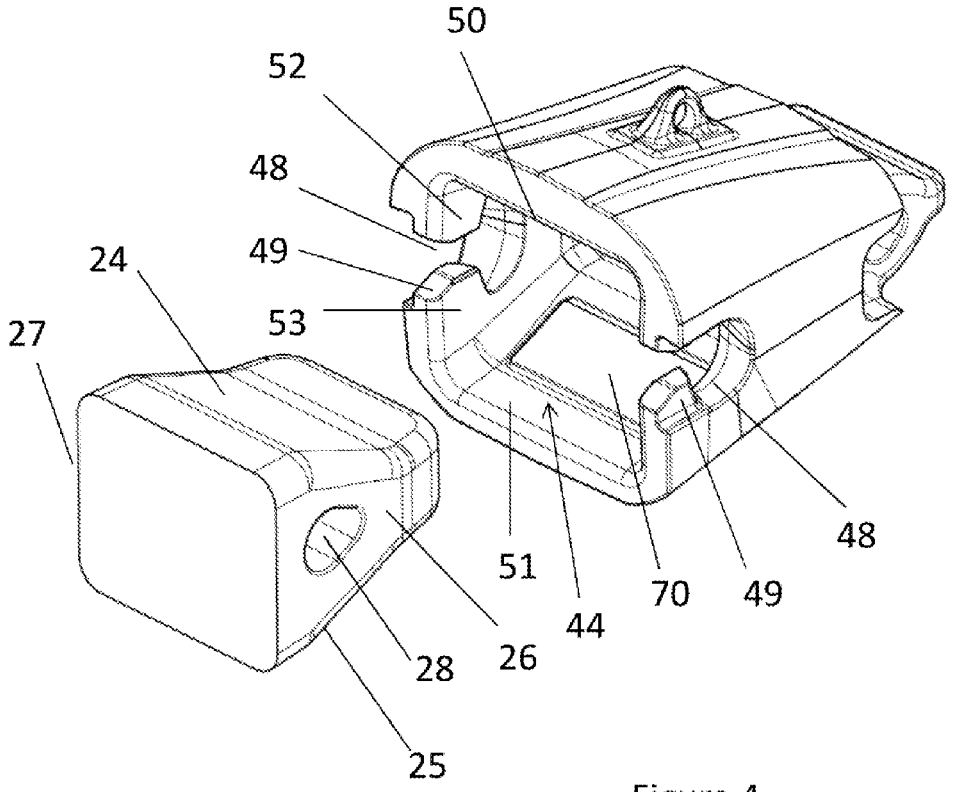
Figure 5:
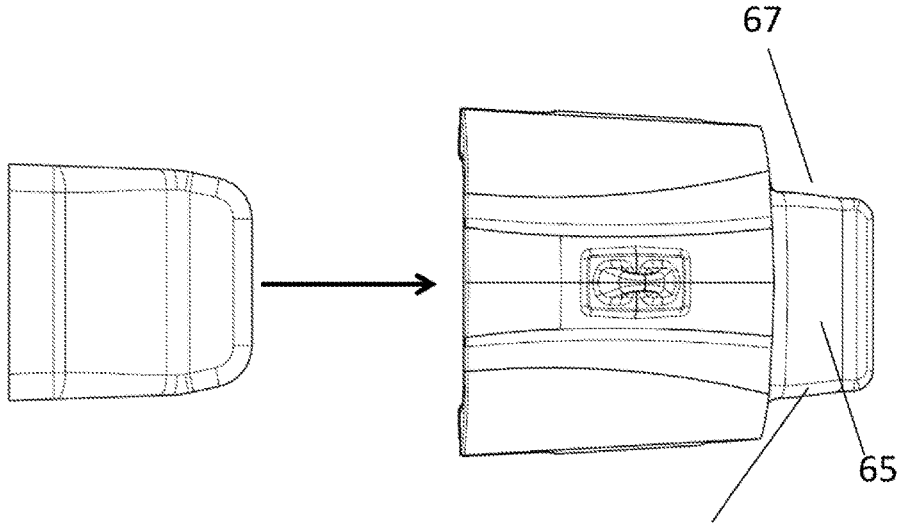
FIG. 5 is a top view of the excavation tooth assembly of FIG. 1 in an unassembled condition.
Figure 6:
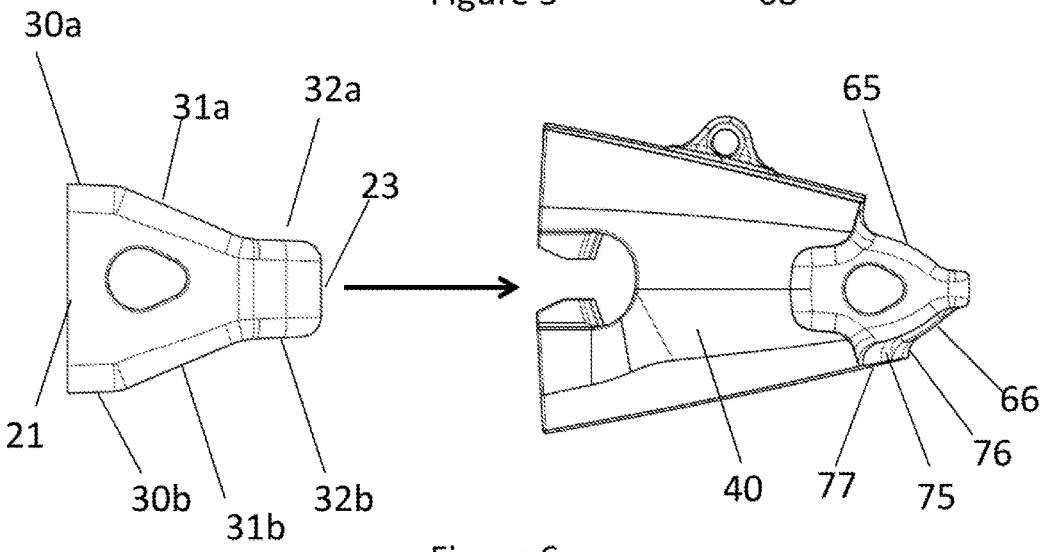
FIG. 6 is a side view of the excavation tooth assembly of FIG. 1 in an unassembled condition.

As shown in FIG. 2, the second and third surface portions 61 *a,b* and 62*a,b* of the top and bottom inner surfaces 50, 51 of the socket 44 are bearing surfaces which bear on the respective second and third surface portions 31 *a,b* and 32*a,b* of the top and bottom surfaces 24, 25 of the nose body 20. Whereas the first surface portions 60*a,b* of the top and bottom inner surfaces 50, 51 of the socket 44 do not bear on the nose 11 and are spaced from respective first surface portions 30*a,b* of the top and bottom surfaces 24, 25 of the nose body 20.

In the embodiment illustrated in the Figures, the second surface portions 61 *a,b* of the top and bottom inner surfaces 50, 51 of the socket as well as the end surface 46 of the socket 44 incorporate stabilising pads 70 which engage opposed surfaces of the nose 11. The pads 70 may be integrally formed with or welded to the respective surfaces of the socket. The pads 70 provide a better fitment of the socket with the nose.

The second surface portions of the nose body and the socket 31 *a,b* and 61 *a,b* respectively, are the largest surface portions of the nose body and the socket. Accordingly, with these surfaces bearing on each other, the intermediate tooth member 12 and the nose 11 are highly stable when assembled together.

Although the above description has been provided in respect of the top and bottom surfaces of the nose body and the socket, it is to be understood that in other embodiments, the opposite side surfaces of the nose body and the socket could be shaped in a similar manner in addition to or instead of the respective top and bottom surfaces.

As previously referred to, the nose portion 14 of the intermediate tooth member 12 is configured to be received in the socket 80 of the point tooth member 13. The nose portion 14 has upper and lower surfaces 65, 66 that converge as they towards the second end 43 of the intermediate tooth member's body 40 and side surfaces 67, 68 that respectively extend between the upper and lower surfaces. The cavity 47 for receiving the further lock 15 extends between the side surfaces 65, 66.

As is shown in particular in FIG. 1, the nose portion 14 has a central longitudinal axis B-B which is offset from the central longitudinal axis A-A of the intermediate tooth member 12. This gives the intermediate tooth member 12 an asymmetrical shape about its longitudinal axis A-A. The purpose of this shaping is to enable there to be greater space on one side of the nose portion 14 to accommodate a larger and more robust locking portion of the further lock 15 as will be described in further detail below.

The intermediate tooth member 12 also has recesses 69*a, b* formed externally on opposite sides of the tooth member's body 40. These recesses 69, *b* extend rearwardly of the nose portion 14 and are shaped to receive arms of the point tooth member 13 when it is in an assembled condition with the intermediate tooth member 12. Because the nose portion 14 is offset from the longitudinal axis of the intermediate tooth member, one of the side recesses 69*a* is wider than the other 69*b*.

On the lower surface 66 of the nose portion 14, a projection 75 is formed. The projection 75 is in the form of a ridge that extends from the rear of the nose portion 14 towards the second end 43 of the intermediate tooth member's body. The projection 75 presents a curved facing surface 76 when the intermediate tooth member is viewed from the second end. The projection 75 also has an outer surface 77 that is flush with and forms an extension of the lower outer surface of the intermediate tooth member's body 40. The ridge 75 also has a portion 78 extending from the curved facing surface along the lower surface 66 of the nose.

The projection 75 is formed during the casting process used to manufacture the intermediate tooth member as a riser in the mould. This helps the casting cool more evenly and thus reduces cracking of the intermediate tooth member as it is formed. As a result, less castings have to be discarded because of forming problems and the intermediate tooth member having the projection 75 is more efficiently produced.

The point tooth member 13 also comprises a body 81 extending forwardly from a first end 82 to end in a digging edge 83 at a second end 84 of the body. The body 81 has top and bottom walls 87, 88 which converge towards the digging edge 83. The socket 80 of the point tooth member 13 extends into the body 81 from an opening 85 at the body's first end 82 towards the second end 84, finishing in an end surface 86. The socket 80 receives the nose portion 14 when mounted to the intermediate tooth member 12. As with the nose portion 14 of the intermediate tooth member 12, the central longitudinal axis D-D of the socket 80 is also offset from the central longitudinal axis C-C of the point tooth member's body 81. The point tooth member 13 is thus also asymmetrical about its longitudinal axis.

The socket 80 is defined by top, bottom and side inner surfaces 90-93 of respective walls of the point tooth member body 81, in addition to the socket end surface 86. The top and bottom inner surfaces 90, 91 of the socket converge towards each other as they extend from the first end 82 of the body to the socket end surface 86. The inner surfaces 90-93 of the socket 80 are shaped to provide suitable engagement with the surfaces of the nose portion 14 of the intermediate tooth member 12.

The point tooth member 13 also comprises arms 94*a, b* located to either side of the body 81 and extending rearwardly of the body away from the socket opening 85. The arms 94*a, b* are shaped to be received in respective side recesses 69*a, b* of the intermediate tooth member 12 when the tooth members 12, 13 are in an assembled condition. Because of the asymmetric arrangement of the point tooth member socket 80, one of the arms 94*a* is thicker than the other 94*b*. In addition, the wall of the point tooth member body on that side is thicker than the wall on the other side. The thicker arm 94*a* is configured to be received in the wider side recess 69*a* of the intermediate tooth member 12.

Figure 9:
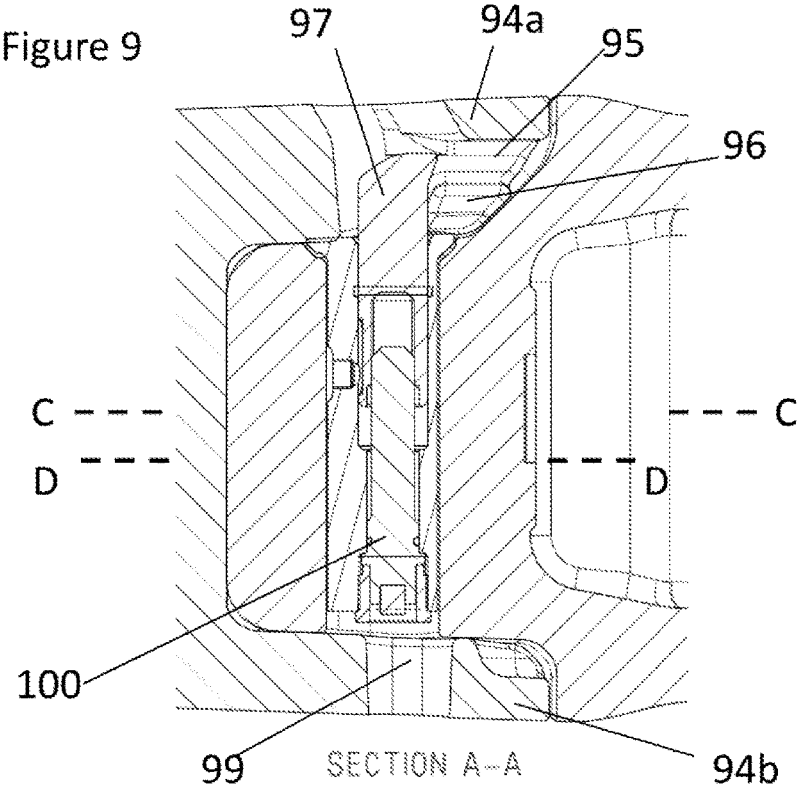
FIG. 9 is a cross-sectional top view of the point tooth member, the lock and the intermediate tooth member in their assembled condition through A-A of FIG. 8.
Figure 10:
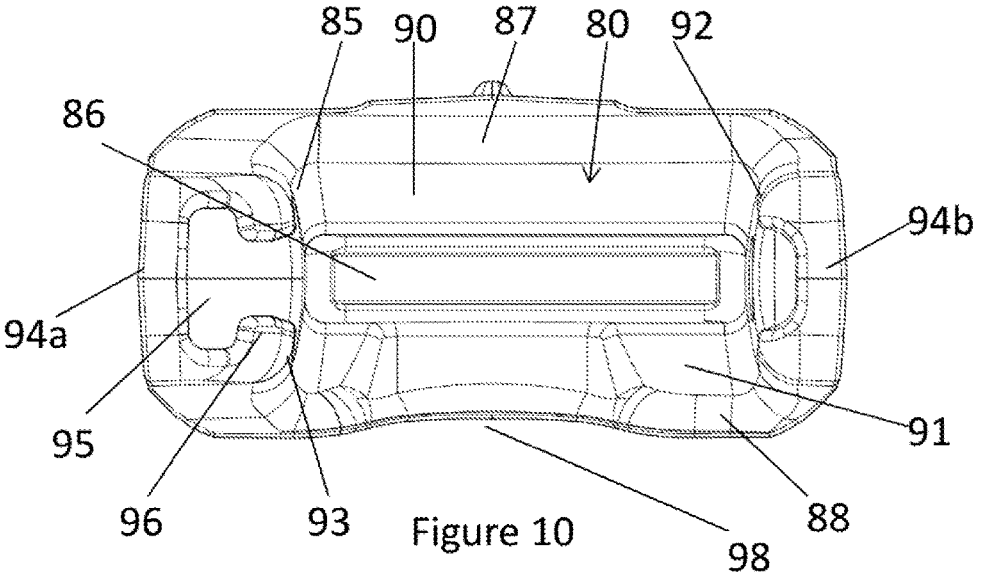
FIG. 10 is a rear view of the point tooth member.
Figure 11:
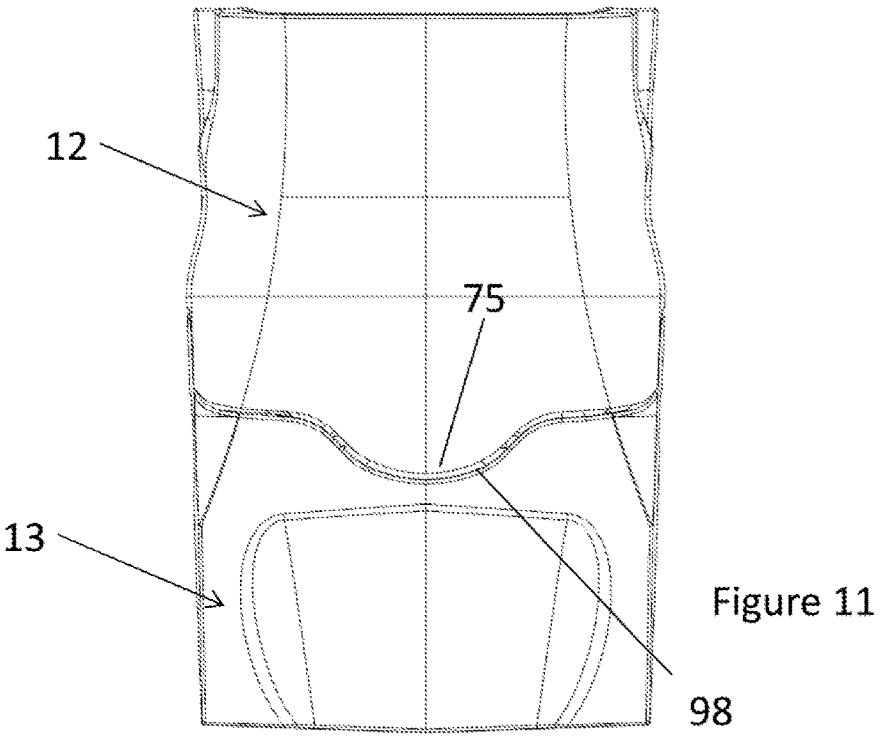
FIG. 11 is an underneath view of the intermediate tooth member and the point tooth member in an assembled condition.
Figure 12:
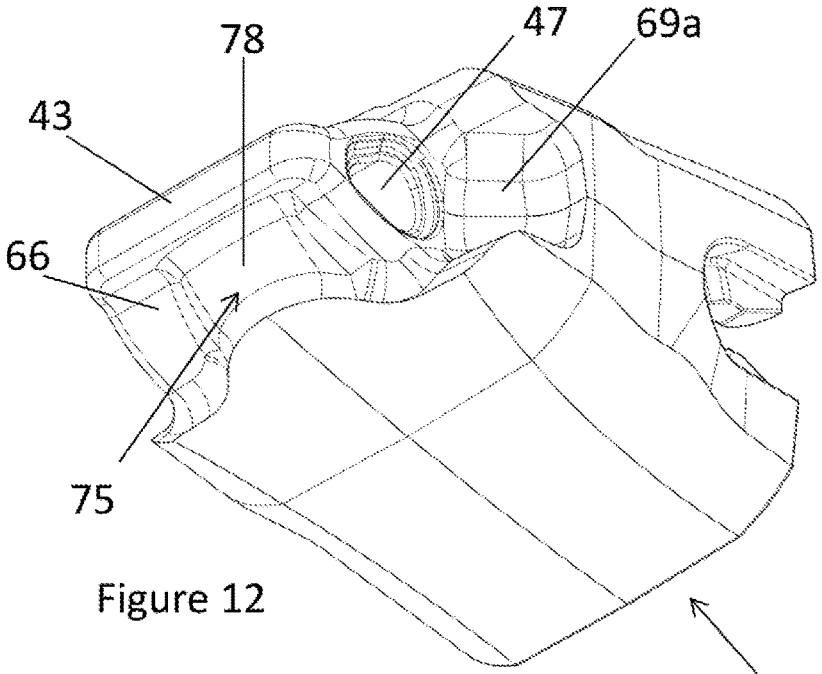
FIGS. 12 and 13 are perspective views from underneath of the intermediate tooth member of FIG. 1.
Figure 13:
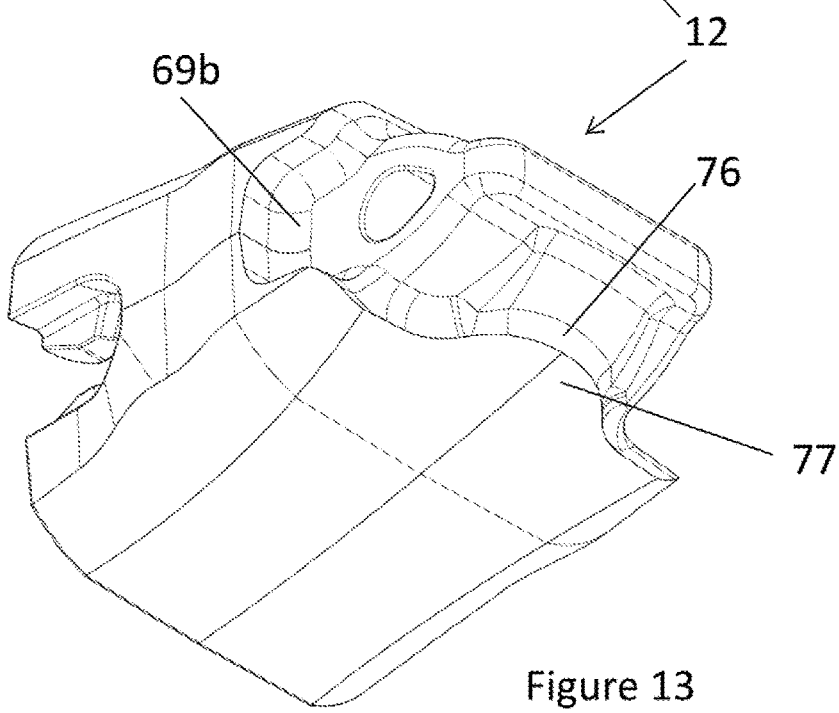

As shown in FIG. 9, the point tooth member 12 has a slot 95 that opens at the distal end of the thicker arm 94*a* from the tooth member body 81 and extends into body 81. The slot 95 is also open to the socket 80 and comprises an engagement portion 96 for a locking element 97 of the further lock 15 to engage when locking the point tooth member 13 to the intermediate tooth member 12.

Figure 7A:
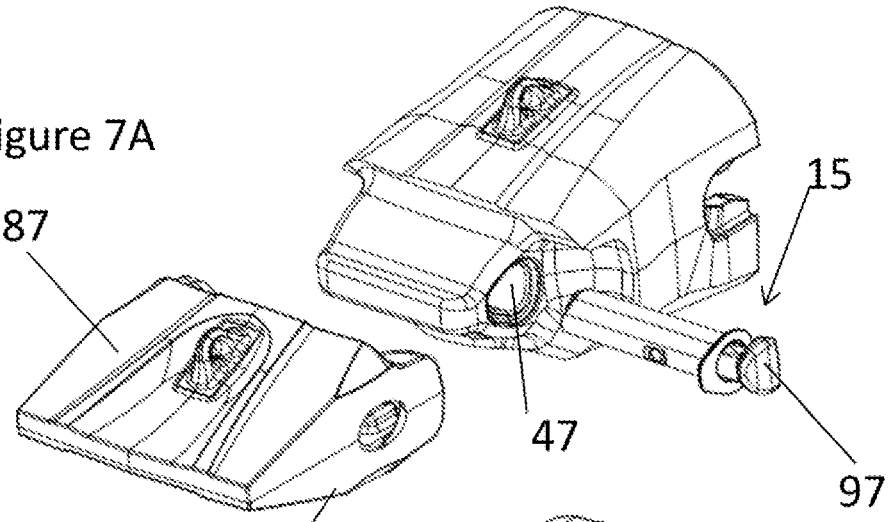
FIGS. 7A-C are perspective views of a point tooth member being sequentially mounted and locked to the intermediate tooth member of FIG. 1 using a lock. The point tooth member and the lock also being part of the excavation tooth assembly of FIG. 1.
Figure 7B:
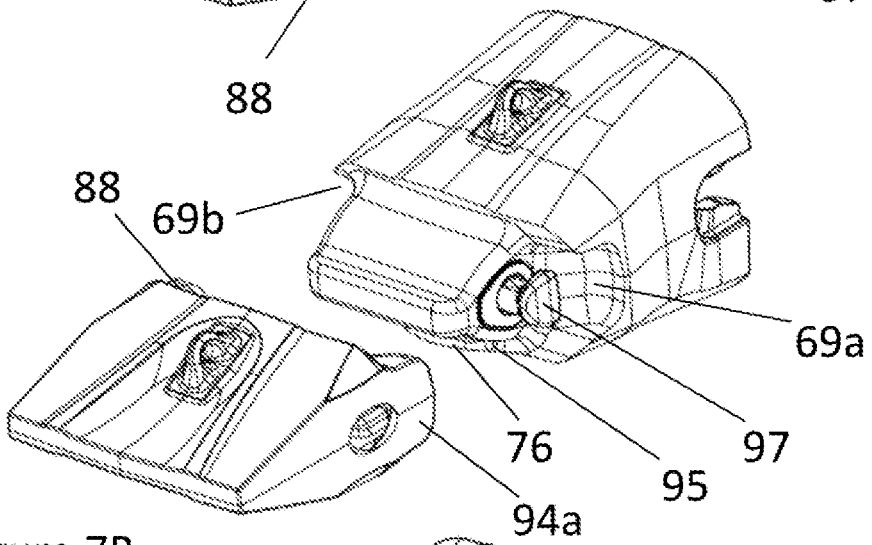
Figure 7C:
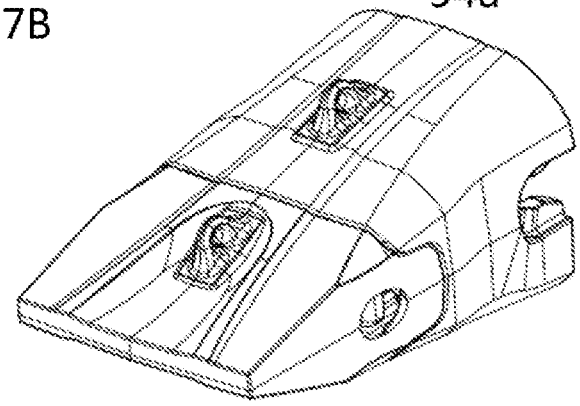
Figure 8:
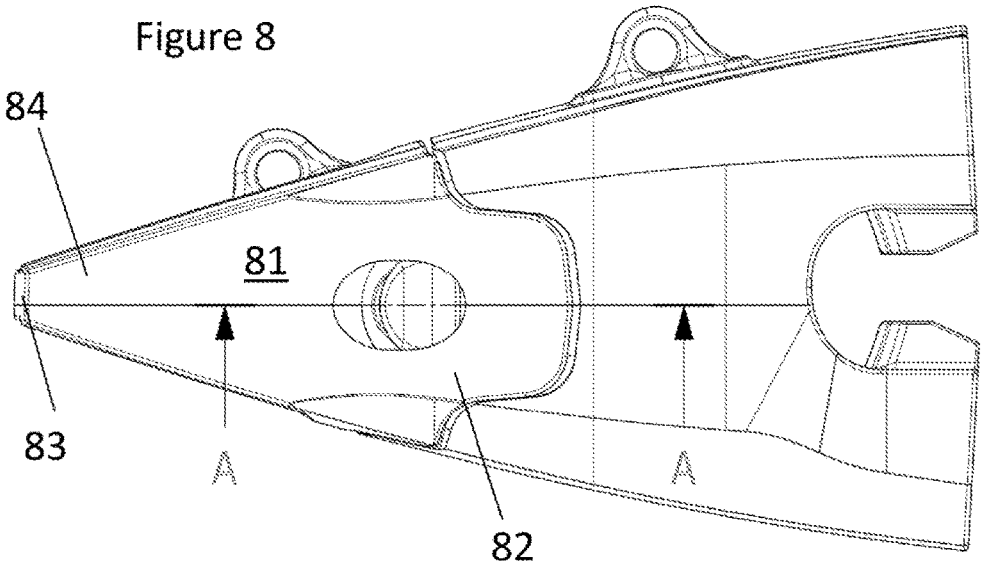
FIG. 8 is a side view of the point tooth member of FIGS. 7A-C assembled with the intermediate tooth member.

Referring to FIGS. 7A-C, the point tooth member 13 is assembled with and locked to the intermediate tooth member 12 by first inserting the further lock 15 into the cavity 47 of the nose portion 14, with the locking element 97 remaining projecting out of the cavity (to the side the larger side recess 69*a* is formed in the intermediate tooth member). The point tooth member 13 is then mounted to the intermediate tooth member 13 by receiving the nose portion 14 in the socket 80, with the slot 95 allowing the thicker arm 95*a* of the point tooth member 13 to slide over the locking element 97 of the lock and be received in the side recess 69*a* of the intermediate tooth member.

A recess 98 is provided in the bottom wall 88 of the point tooth member 13 to enable the point tooth member to fit around the projection 75 formed on the lower surface 66 of the nose portion 14.

The further lock 15 is then retracted by moving the locking element 97 towards the nose portion 14, which results in the locking element 97 being brought into engagement with the engagement portion 96 formed in the slot 95 of the point tooth member 13. An aperture 99 is provided on the opposite side of the point tooth member 13 to the slot 95 which enables tool access to the further lock 15 to operate an actuator 100 which causes movement of the locking element 97.

Because of the asymmetry of the point and intermediate tooth members, the locking element 97 and the arm 94*a* and the side wall of the point tooth member body in which the slot 95 is formed are thicker than if the tooth members were symmetrical about their longitudinal axis. This makes these parts and their locking engagement more robust and reduces the likelihood of failure in use.

Disassembly of the point tooth member 13 from the intermediate member, for example to replace a worn or broken point tooth member 13, essentially follows a reverse of the above described assembly process. However, notably, it is not necessary to remove the further lock 15 from the cavity 47 of intermediate tooth member nose portion 14 if all that is required is to replace the point tooth member with a new one. This makes the process of replacing worn or broken point tooth member's quicker and reduces downtime of the excavation equipment to which the tooth assembly 10 is attached.

In the claims which follow and in the preceding disclosure, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the present disclosure.

Accordingly, the present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods which can, of course, vary. It is also to be understood that the terminology used herein is for the purpose of describing particular embodiments only, and is not intended to be limiting.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

The invention claimed is:

1. An excavation tooth assembly comprising:

a first tooth member comprising a body extending away from the digging edge when attached thereto along a central longitudinal axis from a first end to an opposite second end, the body having a nose portion that extends to the second end of the body, the nose portion that extends to the second end of the body defined by top, bottom and opposite side surfaces, the nose portion having a central longitudinal axis that is offset to the side from the central longitudinal axis of the body along the digging edge when attached thereto; and a second tooth member including a socket, the first and second tooth members arranged in an assembled condition where the nose portion of the first tooth member is received within the socket of the second tooth member, wherein, when in the assembled condition, a space is defined between an inner wall of the socket and the other side surface of the nose portion, the space being configured to accommodate a lock for locking the second tooth member to the first tooth member.

2. The excavation tooth assembly of claim 1, wherein the second tooth member comprises a body extending between opposite first and second ends and having a central longitudinal axis and the socket has a central longitudinal axis that is offset from the central longitudinal axis of the body.

3. The excavation tooth assembly of claim 1, wherein the first tooth member has recesses formed in the body on either side of the nose portion for receiving part of the second tooth member in the assembled condition.

4. The excavation tooth assembly of claim 3, wherein one of the recesses is wider than the other.

5. The excavation tooth assembly of claim 3, wherein the second tooth member comprises arms extending away from the socket on either side of the second tooth member for receipt in respective side recesses in the first tooth member.

6. The excavation tooth assembly as claimed in claim 5, wherein one of the arms is thicker than the other.

7. The excavation tooth assembly of claim 1, wherein the second tooth member has opposite upper and lower walls and opposite side walls which define the socket, wherein one of the opposite upper and lower walls is thicker than the other or one of the opposite side walls is thicker than the other.

8. The excavation tooth assembly of claim 7, wherein the thicker wall of the second tooth member has an engagement portion for engagement by a lock to lock the second tooth member to the first tooth member in the assembled condition.

9. The excavation tooth assembly of claim 6, wherein the second tooth member has opposite upper and lower walls and opposite side walls which define the socket, wherein one of the opposite upper and lower walls is thicker than the other or one of the opposite side walls is thicker than the other.

10. The excavation tooth assembly of claim 9, wherein a slot extends along the thicker arm into the thicker wall.

11. The excavation tooth assembly of claim 10, wherein an engagement portion that is engaged by a lock to lock the tooth members in the assembled condition is located in the slot.

12. The excavation tooth assembly of claim 1, wherein the nose portion of the first tooth member has at least two surface portions which converge towards the second end of the body and the first tooth member also includes a projection on one of the converging surface portions and wherein the socket of the second tooth member has a plurality of walls, one of which has a recess for receiving the projection when the tooth members are in the assembled condition.

13. The excavation tooth assembly of claim 12, wherein at least two of the walls of the second tooth member converge as they extend from a first end towards a second end of the second tooth member, and wherein the recess for receiving the projection is formed in one of the converging walls.

14. The excavation tooth assembly of claim 12, wherein, the projection has a surface facing to the second end of the first tooth member's body.

15. The excavation tooth assembly of claim 12, wherein the projection extends along the surface portion of the nose portion towards the second end of the first tooth member body.

16. The excavation tooth assembly of claim 15, wherein the projection thickens as it extends towards the first end of the first tooth member body.

17. The excavation tooth assembly of claim 12, wherein the projection has a major surface that is an extension of a surface of the first tooth member body.

* * * * *